United States Patent [19]

Merzagora

[11] 4,026,210

[45] May 31, 1977

[54] PRINTING APPARATUS AND METHOD

[75] Inventor: Frank Merzagora, Montreal, Canada

[73] Assignee: Rotobind Ltd., Montreal, Canada

[22] Filed: July 7, 1975

[21] Appl. No.: 593,562

Related U.S. Application Data

[63] Continuation-in-part of Ser. No. 571,622, April 24, 1975, abandoned.

[52] U.S. Cl. ..... 101/350; 101/169; 101/248; 101/352; 101/367

[51] Int. Cl.[2] ..... B41F 31/36; B41F 31/30

[58] Field of Search ..... 308/72; 101/181, 183, 101/348–350, 364, 366, 248, 169, 157, 351, 352

[56] References Cited

UNITED STATES PATENTS

| | | | |
|---|---|---|---|
| 2,513,394 | 7/1950 | Barrett et al. | 101/364 X |
| 2,688,919 | 9/1954 | Kaiser | 101/157 |
| 2,988,989 | 6/1961 | Crawford | 101/181 X |
| 2,997,952 | 8/1961 | Horrocks et al. | 101/181 |
| 3,026,796 | 3/1962 | Crawford | 101/157 |
| 3,163,109 | 12/1964 | Stelling, Jr. | 101/349 |
| 3,233,539 | 2/1966 | Cahn | 101/181 X |
| 3,361,059 | 1/1968 | Klinger | 101/169 |
| 3,563,173 | 2/1971 | Harless | 101/350 X |
| 3,611,926 | 10/1971 | Johnson | 101/350 X |
| 3,729,238 | 4/1973 | Arnold | 308/72 |
| 3,738,265 | 6/1973 | Saneressig | 101/157 |
| 3,756,152 | 9/1973 | Abler | 101/350 |
| 3,780,670 | 12/1973 | Abler et al. | 101/169 |
| 3,855,927 | 12/1974 | Simeth | 101/350 |

OTHER PUBLICATIONS

Berliner et al., *Self Aligning Roll Scraper*, IBM Technical Disclosure Bulletin, vol. 18, No. 2, p. 326, 7/75.

*Primary Examiner*—Edgar S. Burr
*Assistant Examiner*—William Pieprz
*Attorney, Agent, or Firm*—Diller, Brown, Ramik & Wight

[57] ABSTRACT

An improved flexographic printer having a separate ink trough and doctor blade assembly, the ink trough providing an ink film to an ink roll and the doctor blade assembly metering the ink on the cylindrical surface of the ink roll. The improved flexographic printer includes a frame, an ink roll rotatably mounted on said frame, and an ink trough supported by said frame adjacent a cylindrical surface of the ink roll. A pair of pivotably mounted members are supported by said frame, each member having a first arm, the pair of first arms supporting a reverse angle doctor blade assembly. The reverse angle doctor blade assembly is adapted to be advanced by said pivotably mounted members into an operative position adjacent the cylindrical surface of the ink roll at a location on the cylindrical surface intermediate a location of the ink trough and a further location where the ink roll is adapted to engage a printing roll, in a direction of rotation of the ink roll. A second arm of each pivotably mounted member is engaged by actuator means adapted to apply a force to each member, thereby pivoting each pivotably mounted member about a respective pivot point, such that a doctor blade supported by the doctor blade assembly is biased into line contact with the cylindrical surface of the ink roll.

11 Claims, 9 Drawing Figures

282
276
274
278
294
22
260
284
296
86
79
52
158
298
88
78
54
92
34
40
286
290
264
288
268
266
122
272
270
44
66
42
28
94
292
124
114
120
25
24
26
27
140
16
10
20
12
300
32
132
133
126
261
118
260
262
130
136
138
131
128
258
256
176
303
304
306
134
172
18
164
168

PRINTING APPARATUS AND METHOD

CROSS REFERENCE TO RELATED APPLICATIONS

This application is a continuation-in-part of application Ser. No. 571,622, filed Apr. 24, 1975, now abandoned.

BACKGROUND OF THE INVENTION

1. Field of the Invention

This invention relates generally to a flexographic printer, and, in particular, to such a printer which utilizes an improved reverse angle doctor blade assembly.

2. Description of the Prior Art

The function of a conventional doctor blade asssembly in association with a flexographic printer is to remove excess ink from the surface of the anilox roll and provide a uniform ink film to a printing roll over a broad range of ink viscosities and press speeds. However, in recent years, the demand for improved quality in flexographic printing at higher operating speeds has resulted in the development of the reverse angle doctor blade assembly in association with an anilox roll or ink roll, both terms being synonymous in the printing industry. The reverse angle doctor blade assembly shears the ink from the surface of the anilox or ink roll and has the advantage over the conventional doctor blade assembly of removing small particles of dust, pigments, and similar contaminants from the surface of the anilox roll which might otherwise work their way between the blade and the anilox roll and thereby cause undesirable streaking.

By utilizing the reverse angle doctor blade assembly, no surface ink film remains on the anilox roll except for that which is contained in the cells of the cylindrical surface of the anilox roll. As a result, the reverse angle doctor blade assembly virtually eliminates the possibility of streaking by removing contaminants from the cylindrical surface of the anilox roll at the line of contact of the doctor blade with the surface of the roll. In addition, the reverse angle doctor blade assembly requires less critical adjustment of the doctor blade than in the case of conventional doctor blade assemblies.

While the use of the reverse angle doctor blade assembly provides distinct advantages to a flexographic printer, the use of the same has also been found to present certain drawbacks. For example, it is believed that the use of the reverse angle doctor blade assembly may result in increased wear of the anilox roll. In particular, the anilox roll is provided with a cylindrical surface covered with hard chrome plating which, if removed, results in the exposure of a steel base material which wears very quickly and which corrodes when exposed to moisture. Corrosion and excessive wear of the steel base of the anilox roll necessitate the remaking of the surface of the anilox roll. Thus, maintenance of the ink anilox roll is of considerable importance both with respect to the quality of printing obtained, as well as the maintenance costs associated with maintaining the proper condition of the ink or anilox roll.

SUMMARY OF THE INVENTION

The present invention proposes to provide a reverse angle doctor blade assembly utilizing a steel doctor blade which does not result in increased wear of the chromeplated surface of the ink or anilox roll. As a result, improved metering of the ink on the surface of the anilox roll can be achieved by utilizing a steel blade. In addition, the proposed invention proposes to improve the accessibility to the doctor blade assembly and permit its replacemnt separate from the mechanism supplying ink to the ink or anilox roll.

According to the present invention, the improved flexographic printer includes a frame, an ink roll rotatably mounted on said frame, and an ink trough supported by said frame adjacent a cylindrical surface of the ink roll. A pair of pivotably mounted members are supported by said frame, each member having a first arm, the pair of first arms supporting a reverse angle doctor blade assembly. The reverse angle doctor blade assembly is adapted to be advanced by said pivotably mounted members into an operative position adjacent the cylindrical surface of the roll at a location on the cylindrical surface intermediate a location of the ink trough and a further location where the ink roll is adapted to engage a printing roll, in a direction of rotation of the ink roll. A second arm of each pivotably mounted member is engaged by actuator means adapted to apply a force to each member, thereby pivoting each pivotably mounted member about a respective pivot point, such that a doctor blade supported by the doctor blade assembly is biased into line contact with the cylindrical surface of the ink roll.

BRIEF DESCRIPTION OF THE DRAWINGS

In drawings which illustrate embodiments of the present invention.

DESCRIPTION OF THE PREFERRED EMBODIMENT

Throughout the description of the preferred embodiment, reference is made to the ink roll or anilox roll which are synonymous terms applied to the roll which transfers ink to rubber plates mounted on the printing roll or cylinder.

Figure 1:
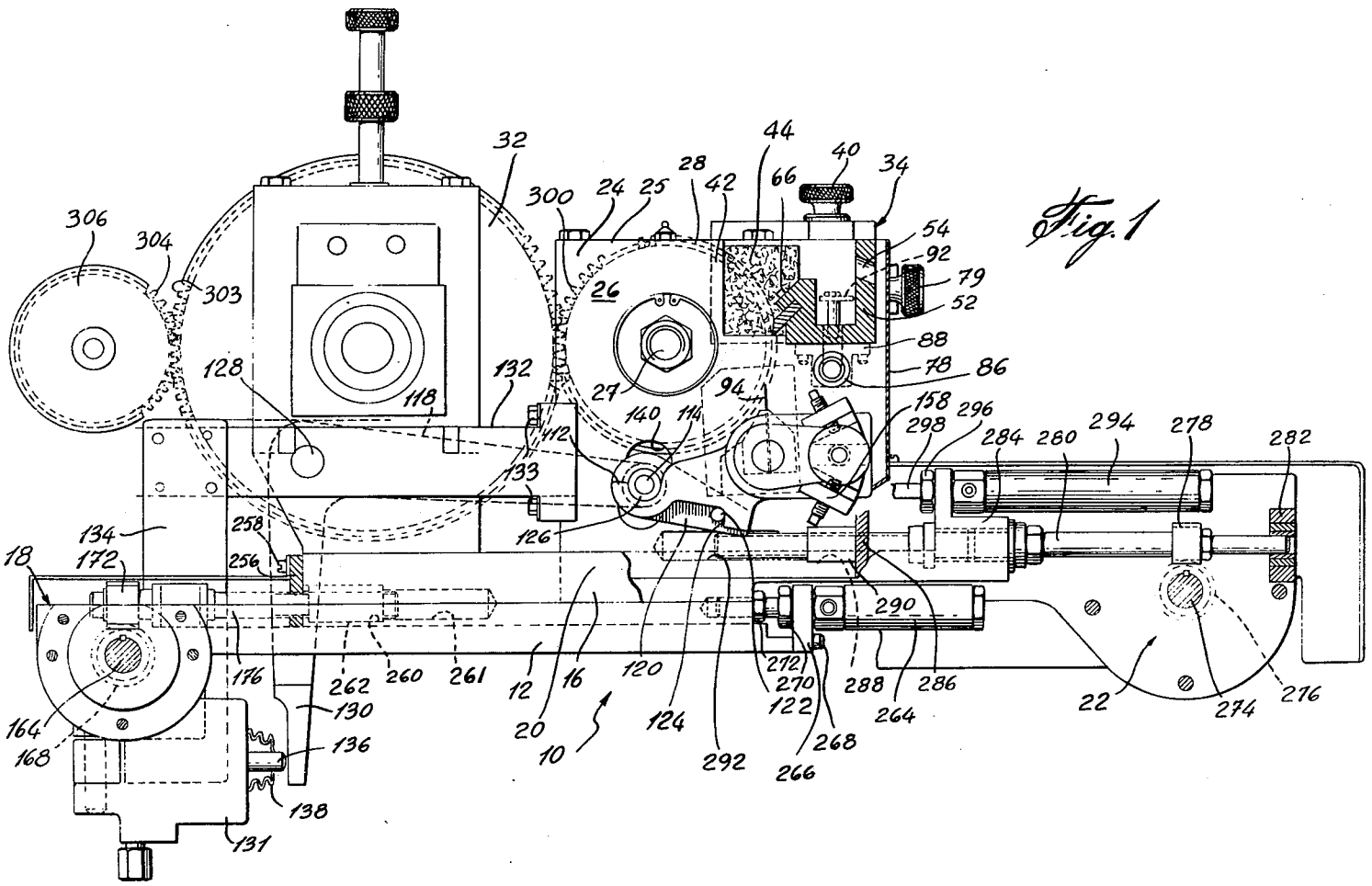
FIG. 1 is a side elevation of the embodiment of the present invention, partly broken away to illustrate some of the constructional features thereof.
Figure 2:
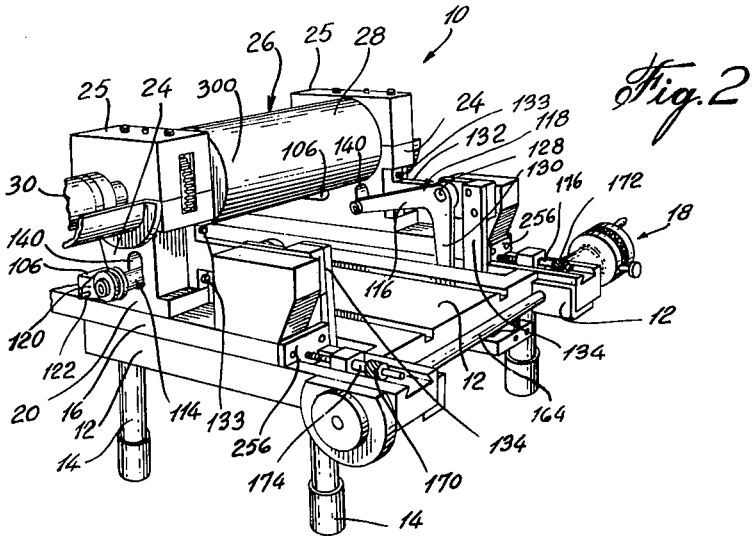
FIG. 2 is a perspective view of the embodiment of the present invention during assembly thereof.

As best seen in FIGS. 1 and 2, the embodiment of the flexographic printer according to the present invention is indicated generally by reference numeral 10. The printer 10 includes a frame comprising a stationary base 12 which, during assembly of the printer, is mounted on legs 14, as seen in FIG. 2. After assembly, the legs 14 are removed from the base 12 and the assembled printer is mounted in a printing machine. Slidably mounted on the stationary base 12 is a second subframe comprising a second pair of longitudinally movable members 16 which can be advanced along the length of the stationary base 12 by means of adjustment means indicated generally by reference numeral 18. The detailed operation and construction of the adjustment means and the manner of moving the second pair of longitudinally movable members 16 relative to the stationary base 12 will be discussed in detail below.

A first sub-frame is movably mounted on the second sub-frame, the first sub-frame including a first pair of longitudinally movable members 20 which are longitudinally movable along the second sub-frame by means of first adjustment means 22. Each of the first pair of longitudinally movable members have a respective ink roll and ink trough support structure 24 mounted thereon. Each support structure 24 is of substantially identical construction and provides support for opposite ends of the ink roll shaft 27. The ink roll 26 has a cylindrical surface 28 containing a number of minute depressions which are intended to contain ink to be applied to rubber printing plates mounted on a printing or plate cylinder 32, as will be discussed in greater detail below.

Figure 3:
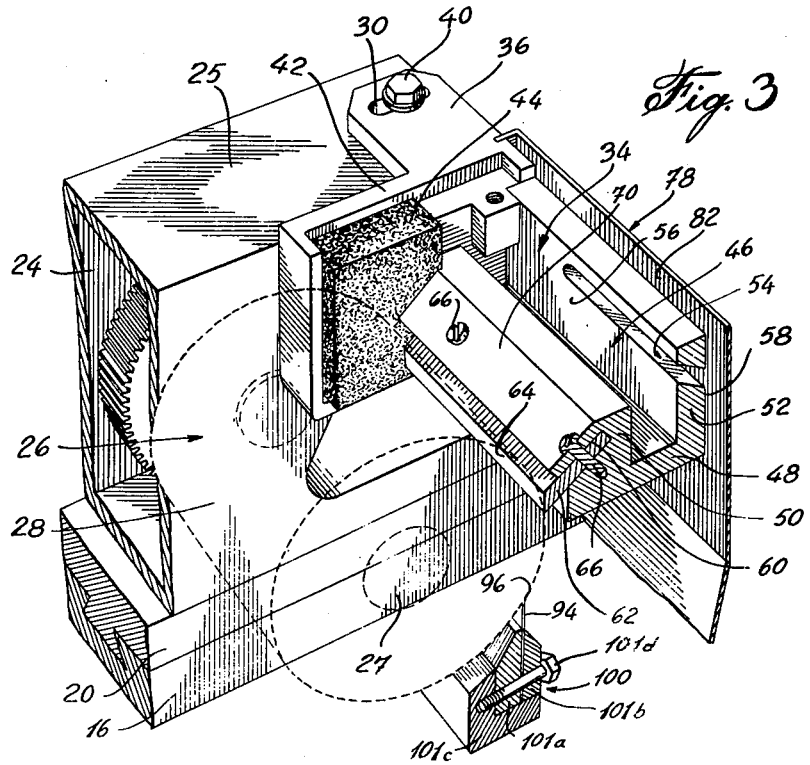
FIG. 3 is a fragmentary perspective view of the ink trough and doctor blade assembly portions of the present invention.
Figure 4:
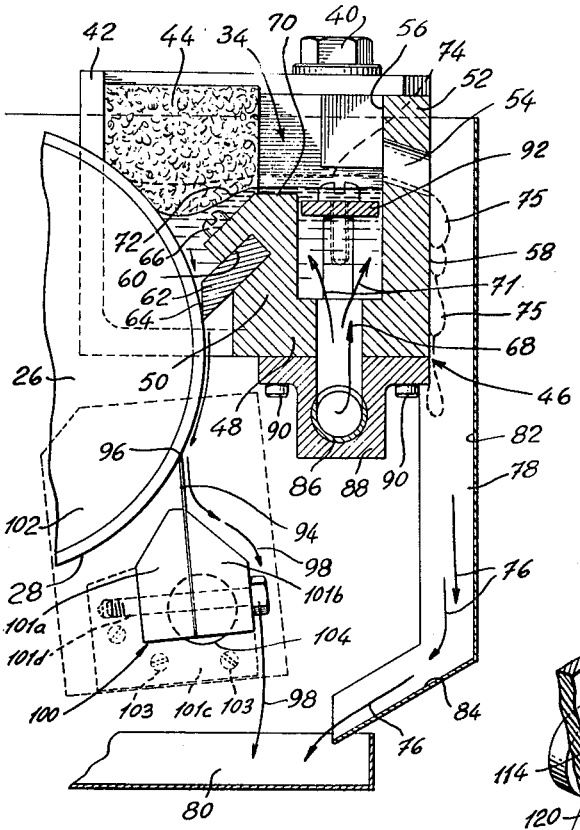
FIG. 4 is a side view of the components appearing in FIG. 3.

The cylindrical surface 28 of the anilox roll 26 is chrome plated in order to increase the wearability of surface 28. Ink is applied to the cylindrical surface 28 by means of an ink trough indicated generally by reference numeral 34. The ink trough 34 is best illustrated in FIGS. 3 and 4, the trough 34 being supported by a pair of flanges 36 which are secured to the upper surfaces 25 of the support structures 24. Each flange 36 includes an elongated slot 38 to permit adjustment of the ink trough 34 relative to the cylindrical surface of the ink roll 26, the ink trough then being secured to the upper surfaces 25 of support structures 24 by means of fasteners 40.

Ink trough 34 extends the width of the anilox roll 26 and includes integral end plates 42 which support blocks of resilient material 44, the inner surfaces of which engage respective opposite end surfaces of the ink roll 26. The inner surfaces of the blocks of resilient material 44 form barriers to prevent the flow of ink along the end surface of the anilox roll 26 during rotation of the latter. One resilient material which has been found to be acceptable for blocks 44 is ETHAFOAM, a trademark of The Dow Chemical Co. for low density, lightweight polyethylene foam. The end plates 42 supporting blocks 44 are interconnected by an elongated central portion 46 comprising a base 48, a front wall 50 having an upper surface which slopes downwardly and a rear wall 52 which is substantially vertical and of a height greater than that of the front wall 50. The rear wall 52 includes an elongated overflow slot 54 which extends downwardly from the inner surface 56 of the rear wall 52 to the outer wall surface 58 thereof.

The front wall 50 includes an elongated slot 60 which extends the length of the front wall, the slot 60 extending upwardly and rearwardly and supporting the rear portion of a teflon blade 62, the blade 62 being retained in slot 60 by means of screws 66. Since slot 60 is sloped downwardly towards its entrance, blade 62 is likewise sloped downwardly towards the cylindrical surface 28 of the anilox roll 26. A leading edge 64 of the teflon blade 62 is bevelled, with the lowermost corner of the leading edge 64 being situated approximately 0.005 inches away from the cylindrical surface 28, the bevelled edge 64 adapted to form a thin ink film on surface 28.

In the embodiment illustrated in FIG. 4, speeds of operation of the printer in excess of 900 feet per minute have resulted in an uneven ink distribution on the cylindrical surface of the anilox roll. As a result, an ink trough and pre-doctor blade construction as illustrated in FIG. 9 has been found to achieve optimal distribution of ink on the anilox roll, even when operating at the maximum operational speed of the printer of 1200 feet per minute.

Figure 9:
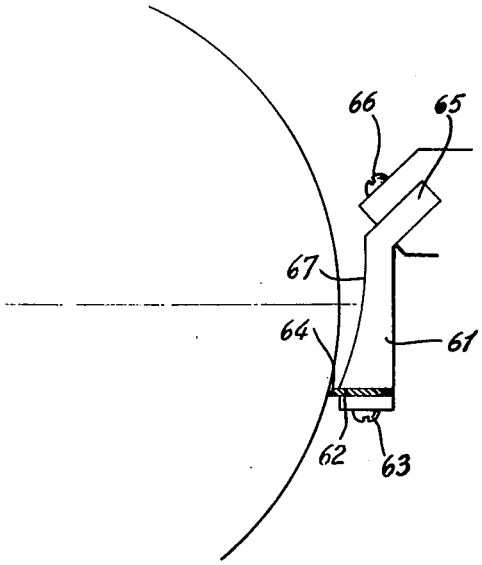
FIG. 9 is a schematic side elevation of a modification of the ink trough and predoctor blade assembly.

In FIG. 9, the teflon blade 62 is secured by means of screws 63 to the lowermost edge of a blade bracket 61 with the leading edge 64 of the blade being in contact with the cylindrical surface of the anilox roll. The upper end 65 of the bracket 61 is secured in slot 60 by means of screws 66. Further, the inner surface 67 of bracket 61 cooperates with the cylindrical surface of the anilox roll to define a funnel-shaped portion which becomes narrower in the direction of rotation of the anilox roll, the funnel-shaped portion containing ink to be applied to the roll.

In order to provide end seals for the modified construction of the ink trough, the blocks 44 have likewise been modified in their construction and extend downwardly at opposite ends of the anilox roll to prevent ink from leaking past the ends of the roll.

While the theoretical explanation is presently not known, it is believed that the improved pre-metering of ink on the anilox roll utilizing the embodiment of FIG. 9 results from the breaking up of an air film carried by the anilox roll during rotation thereof. In particular, it is known that a film of air is formed adjacent the surface of the roll during its rotation, which film prevents ink from filling the depressions in the cylindrical surface of the roll during high speed rotation thereof. As a result, uneven ink distribution on the roll is achieved. The funnel-shaped portion and the placement of the teflon blade, on the other hand, break up the air film to permit the filling of the depressions in the surface of the anilox roll with ink.

A downwardly and forwardly sloped upper surface 70 of the front wall 50 is so designed as to function in the manner of a weir in that ink is directed into the ink trough 34 through an opening 68 in the base portion 48 and fills the space between the rear surface of the front wall 50 and the inner surface 56 of the rear wall 52. Ink continues to flow into this portion of the ink trough until flow passes over the upper surface 70 of the front wall 50 and then along the downwardly sloped portion of the upper surface, thereby filling the space formed between the outer portion of front wall 50, the upper surface of the blade 62, the inner surfaces of the resilient blocks 44, and the adjacent portion of the cylindrical surface 28 of the roll 26. As shown in FIG. 4, the ink flows upwardly in the direction of arrows 71 and fills the ink trough 34 to the level indicated by reference numeral 72.

The elongated overflow slot 54 is designed to limit the over-accumulation of ink in the ink trough 34, such that when ink reaches a level in the trough indicated by dashed lines 74 in FIG. 4, excess ink 75 flows down the elongated overflow slot 54 and along the lower rear surface 58 of the rear wall 52. The flow of overflow ink from the ink trough 34 is indicated by arrows 76 and is directed by splash guard 78 into an ink pan 80 which is mounted on the stationary base 12. The splash guard 78 has a vertical back 82 which is positioned a short distance away from the outer surface 58 of the rear wall 52. The lower portion of the drip pan 78 includes a downwardly and forwardly sloped surface 84 to direct the flow of excess ink into the ink pan 80, From the ink pan 80, ink flows by gravity through a tube to an ink reservoir not shown in the drawings. From the reservoir, ink is pumped through a filter to an inlet pipe 86 which is connected to a support bracket 88 secured by fasteners 90 to the bottom of the ink trough, adjacent the opening 68 therein, as best seen in FIG. 4. A baffle 92 is situated within the ink trough 34 and is held in position above the opening 68 in order to limit splashing of ink as ink is pumped into the ink trough via the opening 68. In addition, baffle 92 also distributes ink along the length of the ink trough 34.

Ink is applied to the cylindrical surface 28 of the anilox roll 26 as the roll 26 rotates clockwise in FIG. 4. Excess ink which has accumulated on the cylindrical surface 28 is metered by a doctor blade 94 which is situated at an acute angle $\alpha$ to a tangent to the surface in the direction of rotation of the roll 26. The angle $\alpha$ varies with the construction of the anilox roll but is generally of the order of 30°. A wiping edge 96 of the doctor blade 94 engages the cylindrical surface, with excess ink being removed from the cylindrical surface and following a path of flow indicated by arrows 98 to the ink pan 80. The doctor blade 94 is made of Swedish blue steel which has been found to have good qualities with respect to wearability while providing accurate metering of ink on the cylindrical surface 28 of the anilox roll 26.

The accuracy of metering of the ink is determined by the amount of ink which remains in the ink cells situated in the cylindrical surface 28 of the anilox roll 26. It has been found, however, that alignment of the wiping edge of the doctor blade with the cylindrical surface 28 can only be obtained by sophisticated and accurate mannual adjustment by an operator, which is time consuming and entirely dependent upon the skill of the particular operator. According to the present invention, accurate alignment of the wiping edge 96 with the cylindrical surface 28 is achieved in the preferred embodiment by supporting a doctor blade assembly 100, which includes the doctor blade 94, in a self-aligning manner against the cylindrical surface of the anilox roll 26.

In addition to including the doctor blade 94, the doctor blade assembly 100 includes front and rear support blocks 101*a* and 101*b* which extend the length of the doctor blade 94 and are located on either side thereof. The support blocks 101*a* and 101*b* are mounted on an L-shaped support block 101*c* which also extends the length of the doctor blade 94. The blocks 101*a* and 101*b*, with the doctor blade 94 therebetween, are secured together by nuts and bolts 101*d* which secure the blocks 101*a* and 101*b* to the front wall of the L-shaped support block 101*c*. End plates 102 are secured to opposite ends of L-shaped support block 101*c* by fasteners 103, the end plates adapted to prevent the side splashing of ink as well as holding the components of the doctor blade assembly 100 together. Each of end plates 102 has a respective shaft portion 104 welded to the outer surface thereof which, when the assembly is mounted on the printer, rest in curved notch portions 106 of the support structures 24, best seen in FIG. 2, while the outer surfaces of plates 102 lie adjacent inner surfaces of support structures 24. First means comprising mounting brackets 108 provided with self-aligning bearings 110 are mounted on each of the shaft portions 104. The self-aligning bearings 110 permit the shaft portions 104 to pivot about an axis transverse to their length, and to the length of the doctor blade assembly, relative to the mounting brackets 108.

Figure 5:
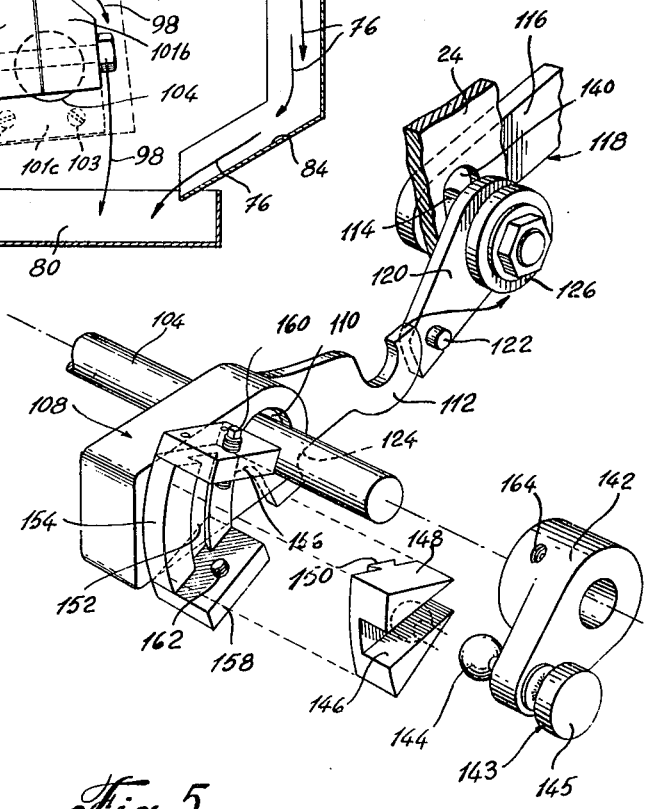
FIG. 5 is an exploded perspective view of the support and adjustment means for the doctor blade assembly.

In FIG. 5, the mounting brackets 108 each include a hook portion 112 which is adapted to engage an axle 114, the axle 114 being rigidly secured to a first arm 116 of a pivotably mounted member 118. Each axle 114 includes a plate 120 which is rigidly mounted thereon, each plate 120 having a pin 122 which is spaced outwardly away from the axle 114. The pin 122 is adapted to engage a notch 124 located in the bottom surface of the mounting bracket 108 once the hook portion 112 is in engagement with the axle 114. The axle 114, plate 120, and pin 122 form second means which cooperate with the first means for pivoting the doctor blade assembly into position relative to the cylindrical surface 28 of the anilox roll 26. Additionally, a narrow cylindrical collar 126 is mounted on axle 114 in spaced fixed relation relative to plate 120, the spacing between plate 120 and cylindrical collar 126 being sufficient to receive the width of the hook portion 112 of mounting bracket 108.

As best seen in FIGS. 1 and 2, the pivotably mounted members 118 are of bell-crank construction, each being pivotably supported about pivot shafts 128. The first arm 116 of each pivotably mounted member extends from the pivot point to the location of axles 114, the first arms 116 being in an approximately horizontal position when viewed in FIG. 1. Each pivotably mounted member 118 includes a second arm 130 which extends downwardly through a slot in the stationary base 12 and extends beneath the lower surface of the base. As can be seen in FIG. 1, the lower end of each second arm 130 is engaged by an actuator means 131 comprising fluid actuated diaphragms, each of which applies a force to the lower end of one of the second arms 130, thereby pivoting the members 118 about the pivot point 128, whereby doctor blade 94 is pivoted into contact with the cylindrical surface 28.

The pivot points 128 are essential with respect to leverage. The maximum balance must be achieved with a minimum amount of pressure, a pressure of approximately two pounds being applied by the actuator means 131. The pivot shafts 128 are mounted from support members 132 which are secured in a cantilever-like manner to the rear surface of support structures 24 by bolts 133. Support members 132 also support downwardly extending brackets 134 which hold the actuator means 131 in position adjacent the lower ends of the second arm 130. Each actuator means 131 includes a piston 136 having a rubber protector 138 thereon in order to prevent the entry of dust or other contaminants into the actuator means.

As can be seen in FIG. 2, the axles 114 extend outwardly from the ends of the first arms 116 of pivotably mounted members 118 through elongated slots 140 located in support structures 24. The slots are curved in order to follow a path of travel of the axle 114 when being pivoted about the pivot point 128. From FIG. 1, it can be seen that the plate 120 mounted on the axle 114 is situated outwardly of the outer surface of the support structure 24.

Initial adjustment of the angle of the doctor blade relative to the tangent to the cylindrical surface 28 of the anilox roll 26 can be achieved by manual adjusting means best illustrated in FIG. 5. The adjusting means can be located in association with either one or both mounting brackets 108. If adjusting means are provided on both brackets 108, only one adjusting means is adjusted at a time. The adjusting means comprises a member 142 having a cylindrical bore to permit mounting of member 142 on at least one of the shaft portions 104 adjacent the end of the shaft portion such that the mounting bracket 108 is situated on the shaft portion 104 between the member 142 and the adjacent plate 102 of the doctor blade assembly 100. The member 142 has engaging means 143 mounted thereon, the engaging means 143 having a threaded portion in contact with the member 142 in order to advance the engaging means relative to the member 142. The engaging means 143 includes a ball-like end 144 which engages a slot 146 in a follower member 148 and a knob 145 for turning engaging means 143 so as to disengage end 144 from slot 146.

The bottom surface of the follower member 148 includes a dove-tail like projection 150 which is slidably mounted in a curved, slotted path 152 located in a member 154, member 154 being secured in position to the side of mounting bracket 108. Member 154 has outwardly extending flange portions 156 and 158 located at opposite ends thereof, with flange portions 156 and 158 supporting respectively combined clamp and adjustment means comprising threaded set screws 160 and 162 respectively. The threaded screws 160 and 162 releasably retain the follower member 148 at a particular location on the curved path 152. Since the member 142 is rigidly secured to the shaft portion 104 by a set screw located in a threaded opening 164 in member 142, and the ball-like end 144 of the engaging means 143 is in engagement with slot 146 of member 148, adjustment of the position of member 148 in slot 152 results in rotation of shaft portion 104 and of the doctor blade assembly 100. In this way, the angle of attack of the doctor blade 94 relative to the cylindrical surface 28 can be adjusted.

Adjustment of the position of the follower member 148 in slot 152 is carried out while the ball-like end 144 of engaging means 143 is in engagement with the slot 146. This adjustment is achieved by manually turning screws 160 and 162, thereby moving the follower member 148 along curved path 152. Since the ball-like end 144 is in engagement with slot 146 in follower member 148, the member 142 supporting engaging means 143 is rotated, as is shaft portion 104 to which member 142 is connected by the set screws referred to above. The ball-like end 144 is so constructed that engagement between the engaging means 143 and the follower member 148 does not impede the effect of the self-aligning bearings 110 in that the shaft portion 104 with its member 142 rigidly secured thereto is tiltable relative to the mounting bracket 108 in that the ball-like end is free to pivot within the slot 146.

One of the particular advantages of the construction of the preferred embodiment is that the doctor blade 94 can be situated in the doctor blade assembly without a great deal of accuracy and the self-aligning bearings and mounting brackets permit the doctor blade wiping edge to automatically assume a parallel relationship with the axis of the anilox roll.

As noted above, the printer 10 includes a stationary base 12 supporting a second pair of longitudinally movable members 16 which can be advanced relative to the stationary base by second adjustment means 18. Likewise, a first pair of longitudinally movable members 20 are movably mounted on the second pair of longitudinally movable members 16, the first pair of longitudinally movable members 20 being adjustable by first adjustment means 22. In the preferred embodiment, the first and second adjustment means 22 and 18 are of identical construction, with second adjustment means 18 being illustrated in FIG. 8 by way of example.

Figure 6:
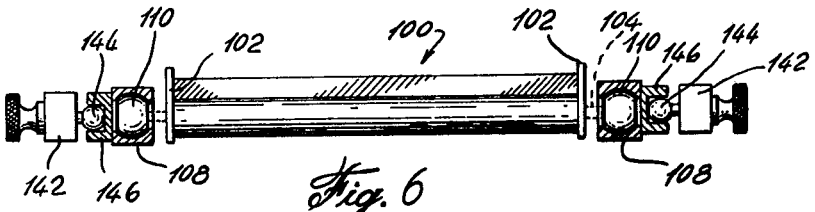
FIGS. 6 and 7 are schematic drawings of the manner of operation of the doctor blade assembly.
Figure 7:
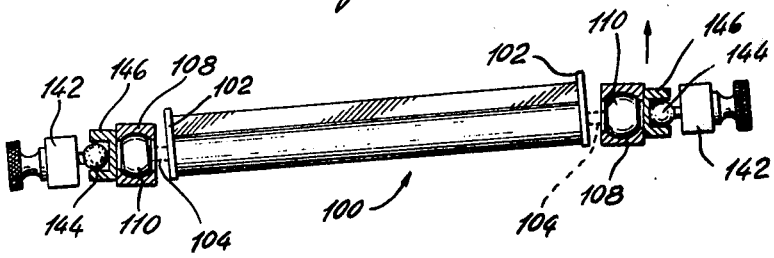

FIGS. 6 and 7 illustrate schematically the manner in which the doctor blade assembly 100 is pivotable about an axis transverse to the length thereof, utilizing the self-aligning bushings 110 mounted in mounting brackets 108, the mounting brackets being connected to the ends of the pivotally mounted members 118. FIG. 7 illustrates in an exaggerated manner that assembly 100 can assume an angle relative to the horizontal and the ball-like ends 144 of engaging means 143 permit pivoting of brackets 108 relative to shaft portions 104.

Figure 8:
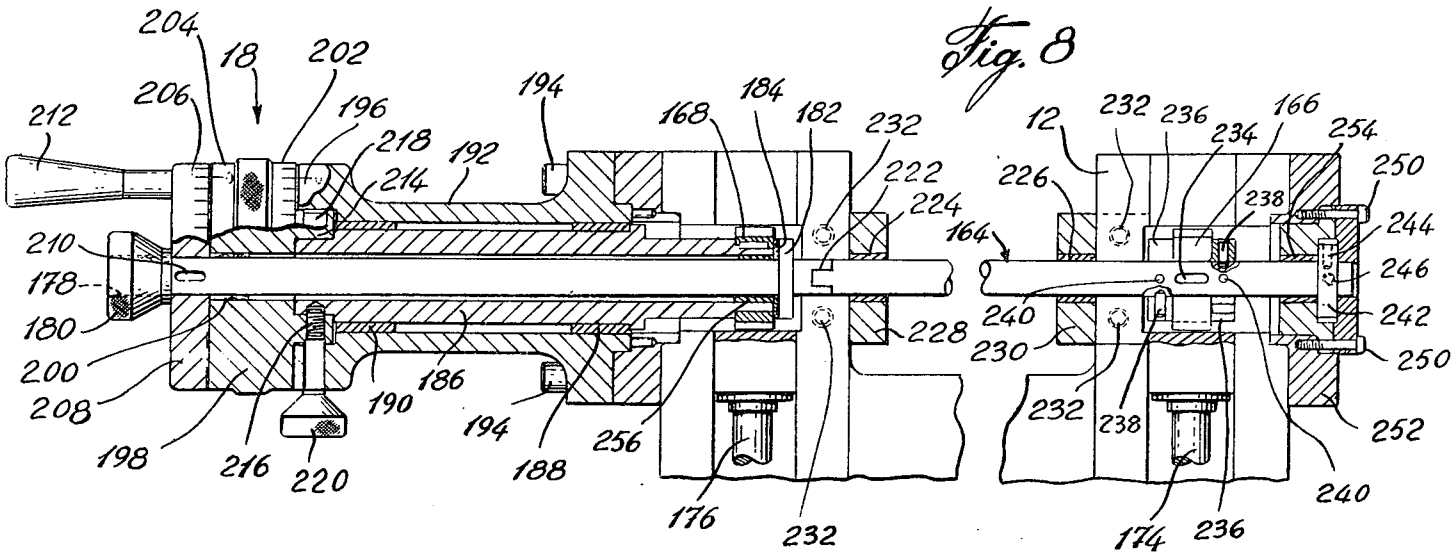
FIG. 8 is a plan view of one of the transverse shafts and adjustment means, partly broken away to illustrate the constructional features thereof.

The second adjustment means 18, as shown in FIG. 8, includes a second transverse shaft 164 supported by stationary base 12, the shaft 164 having two spaced-apart standard helical gears 166 and 168 operatively associated therewith. Gear 166, which is keyed to shaft 164, and gear 168, which is mounted on a collar concentric with shaft 164, mesh with respective gears 170 and 172, the latter two gears being mounted on longitudinally extending shafts 174 and 176 respectively. The outer end of transverse shaft 164 has a threaded portion 178 with a threaded nut 180 mounted thereon. Further, transverse shaft 164 includes an integral shoulder 182 adjacent the location of gear 168, with a friction pad 184 mounted on the shaft 164 between the shoulder 184 and the adjacent side surface of the gear 168. The gear 168 is secured to an elongated collar 186 which is rotatably mounted in bushes 188 and 190, the bushes 188 and 190 being located in a housing 192 which is supported by fasteners 194 to the side of the stationary base 12. Elongated collar 186 is concentrically mounted with respect to shaft 164 with a bush 256 being situated between the collar and the shaft to permit rotation of shaft 164 relative to collar 186.

The outer surface of the housing 192 includes a reference mark 196 situated at the outer end thereof, the mark 196 being situated adjacent a cylindrical member 198 which is rotatably mounted relative to the shaft 164 by a bush 200. Bushes 200 and 256 cooperate to support shaft 164 whereby shaft 164 is fully rotatable with member 198 and collar 186. The right end of the cylindrical surface of the member 198 includes a scale 202 adjacent the reference mark 196, while the left end of the cylindrical surface of the member 198 includes a further reference mark 204 located adjacent a further scale 206 located on a further rotatably-mounted cylindrical member 208. The latter cylindrical member is secured in position on shaft 164 by a key 210 and has an outwardly extending handle 212 for manual rotation of the first adjustment means 18.

The cylindrical member 198 has an annular projection 214 which receives one end of the elongated collar 186 therein. A set screw 216 interconnects the projection 214 with the end of the collar 186, the set screw 216 being removed only when disassembling the adjustment means. The annular projection 214 also includes an annular depression 218 located in the outer surface thereof, the depression 218 adapted to be engaged by one end of a lock nut 220 which is threadedly mounted in housing 192 adjacent the outer end thereof.

In order to permit disassembly of the adjustment means 18, the transverse shaft 164 is separable in two shaft portions at a location 222 which forms a tongue and groove connection between the two shaft portions. Intermediate the location of helical gears 166 and 168, the transverse shaft 164 is supported in bushes 224 and 226, each bush being mounted in the upstanding portion of a respective L-shaped bracket 228 and 230, the horizontal portions of the brackets 228 and 230 being secured by screws 232 to the lower surface of the stationary base 12.

In addition to being secured to the shaft 164 by means of a key 234, the axial position of the gear 166 is maintained stationary by means of a pair of collars 236 mounted on the shaft 164 on either side of gear 166. Each collar 236 has a respective set screw 238 to secure the collar in position by engagement with a depression 240 in the shaft 164. The collars 236 are necessary in order to prevent side movement of the 45° helical gear, which would otherwise occur due to axial forces applied to gear 166. In addition, a further bronze collar 242, mounted close to the end of shaft 164 by means of a set screw 244 engaging a respective depression 246, functions as a thrust collar in order to absorb axial thrusts applied to the shaft 164 through gear 166. The end of transverse shaft 164 is encircled by a cover secured by bolts 250 to a housing 252, the housing being in turn mounted on the side of base 12. Within the housing is located a bush 254 which supports the end of the shaft 164.

The operation of the adjustment means 18 is such as to permit rotation of either one or both of the gears 166 and 168, thereby rotating one or both of longitudinally extending shafts 174 or 176. As noted above, the portion of the shaft 164 between the shoulder 182 and the nut 180 is rotatably mounted within bushes 200 and 256. Further, cylindrical member 208 is keyed to transverse shaft 164 by means of key 210. As a result, when nut 180 is loosened, shoulder portion 182 of shaft 164 moves away from the side surface of gear 168, thereby disengaging the friction pad 184 which is situated therebetween. Thus, rotation of cylindrical member 208 by handle 212 results in rotation of transverse shaft 164 within the bushes 200 and 256 while the cylindrical member 198, elongated collar 186, and helical gear 168, which is secured to the collar 186, remain stationary. Thus, rotation of the gear 166 can be obtained while gear 168 remains stationary. Further, a scale reading can be obtained from scale 206.

In order to obtain rotation of gear 168 by itself, nut 180 remains loosened and cylindrical member 208 is held stationary while the cylindrical member 198 is rotated relative thereto. Rotation of the gear 168 occurs in that the elongated collar 186 is connected to the cylindrical member 198 by means of set screw 216. The scale reading can be obtained from scale 202.

In order to obtain rotation of both helical gears 166 and 168, the nut 180 is tightened on the threaded portion 178 of the shaft 164, whereby the shoulder portion 182 urges the friction pad 184 against the side of the gear 168. In this way, the gear 168 and its elongated collar 186 rotate with the shaft 164, the cylindrical member 198 also rotating in that it is connected to the elongated collar 186 by the set screw 216. Thus, the scale 202 is advanced relative to the reference mark 196 located on the housing 192.

The lock nut 220 can be adjusted in order to engage annular depression 218 after the necessary adjustments have been made by the second adjustment means 18. Engagement of the lock nut 220 with the depression 218 prevents rotation of the shaft 164 when the nut 180 is in its locked position.

Referring to FIGS. 1 and 2, longitudinally extending shafts 174 and 176 extend through plates 256, each of plates 256 being secured by screws 258 to a respective one of the second pair of longitudinally movable members 16. In FIG. 1, only one of the pair of members 16 is shown, so that the description thereof is likewise applicable to the second member 16. Thus, each second longitudinally movable member 16 includes a pair of cylindrical openings adjacent the plates 256, the smaller opening 261 permitting movement of the end of the shafts 174 and 176 therein. The larger of the cylindrical openings 260 supports a non-rotatable cylindrical nut 262 therein, the nut being held in a non-rotatable position within the cylindrical opening 260 by pins, not shown in the drawings, which engage an elongated groove within the surface of the cylindrical nut. The nuts 262 include a threaded bore which engages respective threaded portions of the shafts 174 and 176 therein. By rotating either of shafts 174 and 176, the nuts 262 are advanced along the threaded portions thereof in that the nuts are prevented from rotating by engagement of the pins with the elongated slots in the cylindrical surfaces of the nuts. In this way, longitudinal movement of the longitudinally movable members 16 is obtained. The smaller cylindrical opening 261 is situated within the members 16 in order to permit movement of the members 16 along shafts 174 and 176.

Adjacent the ends of the members 16 opposite from plates 256 are supported a pair of double-acting fluid cylinders 264, only one of which is shown in FIG. 1. Each cylinder 264 is supported from a bracket 266 which is secured to the stationary base 12 by means of bolts 268. Each double-acting fluid cylinder 264 is secured to its respective bracket 266 by means of a nut 270 and each cylinder 264 includes an actuating rod 272 which engages the end of one of the second longitudinally movable members 16.

Likewise, a similar arrangement is provided for the first pair of longitudinally movable members 20 and their respective first adjustment means 22. Since the first adjustment means is illustrated in side view, in FIG. 1, the description will refer only to one of the mechanisms for moving one of the first longitudinally movable members 20. Thus, the first adjustment means includes the first transverse shaft 274 having helical gears 276 operatively associated therewith, gears 276 meshing with further helical gears 278 mounted on first longitudinally extending shafts 280. Each shaft 280, which is supported at one end in a bearing 282 mounted on the stationary base 12, passes through a respective mounting block 284 located part way along the length of the shaft 280. From the mounting blocks 284, each shaft 280 passes through a plate 286 which is secured to one end of the first longitudinally movable member 20. Adjacent the plate 286, each first longitudinally movable member 20 includes a cylindrical opening 288 which supports a cylindrical nut 290 therein. Each cylindrical nut 290 is identical in construction to cylindrical nut 262, having a longitudinal groove engaged by pins which restrict rotation of the cylindrical nut 290 within the opening 288. The nuts 290 have a threaded bore which engages a correspondingly threaded portion of one of the shafts 280. As a result, rotation of shafts 280 initiate movement of the nuts 290 therealong, thereby moving the first longitudinally moveable member 20 within which the cylindrical nuts 290 are closely fitted. Each first longitudinally movable member 20 also includes a smaller cylindrical opening 292 which receives the end of shaft 280 as the first longitudinally movable member advances relative thereto.

The upper portion of each L-shaped block 284 supports a further double-acting fluid cylinder 294 thereon, the cylinder being secured to the upper portion of block 284 by means of a nut 296. Each cylinder 294 includes a forwardly extending rod 298, the end of which is secured to the plate 286.

The function of the four double-acting fluid cylinders 294 and 264 is identical, despite the fact that cylinders 264 are connected to the end of the second pair of longitudinally movable members 16 opposite from the end engaged by the longitudinally extending shafts 174 and 176, whereas the shafts 280 of the first adjustment means 22 and the double-acting cylinders 294 are located at the same end of the first pair of longitudinally movable members 20. Considering the operation of the double-acting fluid cylinders in association with the first pair of longitudinally movable members, a force is applied to a piston located within the cylinder in the direction of movement of the longitudinally movable member as the same is advanced manually by means of the first adjustment means 22, thereby assisting in the longitudinally movement thereof. Thus, if the first longitudinally movable members 20 are being advanced to the left, a force directed to the left in FIG. 1 is applied by means of the rod 298 of the double-acting cylinder 294 to the plate 286.

The function of the first adjustment means 22 is to align the anilox roll 26 with the printing roll 32. As the cylindrical surface 28 of the ink roll 26 engages the rubber plates on the printing roll 32, a gear 300 associated with the ink roll 26 is brought into engagement with a gear 302 which is associated with the printing roll 32. After the gears 300 and 302 are in engagement, the double-acting fluid cylinders 294 continue to apply pressure to the plates 286, thereby locking the anilox roll 26 in engagement with the printing roll 32. A pressure of approximately 45 pounds in a 3/4 inch bore is applied by each of the double-acting fluid cylinders 294.

The double-acting fluid cylinders 294, in addition to locking the anilox roll 26 in position with respect to the printing roll 32, also provide a force to separate the anilox roll 26 from the printing roll 32 whenever the press stops, due to web breakage or the like. When such stoppage occurs, a pressure within the double-acting fluid cylinders 294 causes the rods 298 to move to the right, thereby removing contact between the anilox roll 26 and the rubber plates located in the printing roll 32. The movement provided by the cylinders 294 is only sufficient to separate the cylindrical surface of the ink roll from contact with the rubber plates while maintaining the gears 300 and 302 associated with the ink roll 26 and the printing roll 32 in slight contact. Upon actuation of the cylinders 294 which separate the anilox and printing rolls, a control actuates an electric motor 30 which slowly rotates the ink roll at a slow speed of rotation, for example, 18 revolutions per minute, thereby preventing the drying of the ink on the cylindrical surface 28 of the ink roll 26. The gear 300 which is associated with the anilox roll 26 is provided with a one-way clutch, not shown in the drawings, which permits the ink roll 26 to rotate while the gear 300 is maintained stationary. Since the ink roll is separated from the rubber plates on the printing roll 32, no transfer of ink to the plates occurs.

The gear 302 associated with the printing roll 32 also engages a gear 304 associated with an impression roll 306. In addition to supporting a web during its passage between the impression roll 306 and the printing roll 32 during the printing operation, the impression roll 306 provides the drive for both the printing roll 32 and the anilox roll 26 via the gears 304, 302 and 300. Further, while the size of the impression roll 306 and ink roll 26 remain constant, the size of printing cylinder 32 utilized varies depending on the nature of the work. For this reason, the first and second adjustment means 18 and 22 permit movement of the first and second subframes mounted on the stationary base 12 over a distance in excess of four inches. The second adjustment means 18 is provided in order to bring the printing and anilox rolls, which have been aligned by means of the first adjustment means 20, into aligned engagement with the impression roll 306.

After the three rolls are brought into alignment, ink is supplied to the ink trough 34 via an ink pump, the ink being spread over the cylindrical surface 28 of the ink roll 26 as the same is rotated. The ink film on the surface 28 is metered by the doctor blade 94, the remaining ink on the cylindrical surface 28 being transferred to the rubber plates mounted on the cylindrical surface of the printing roll 32. Ink on the rubber printing plates is transferred to the web which passes between the impression roll 306 and the printing roll 32 during rotation thereof.

A control system is provided whereby pressure is applied to the actuator means 131 upon rotation of the ink roll 26, whereby the pivotably mounted members 118 are rotated about their pivot points 128, thereby biasing the doctor blade 94 into engagement with the cylindrical surface 28. Alignment of the wiping edge 96 of the doctor blade 94 with the cylindrical surface 28 is achieved automatically by means of the mounting brackets 108 and self-aligning bearings 110, thus avoiding the necessity of manual adjustments by an operator, which are dependent entirely upon the skill of the particular operator. Likewise, a control system is provided, but is not shown in the drawings, whereby any stoppage in printing results in actuation of the double-acting cylinders 294, as described above, and actuation of the electric motor 30 for rotation of the anilox roll 26.

I claim:

1. An improved flexographic printer including:

a frame;

an ink roll, the ink roll being rigidly mounted on a shaft, the shaft and ink roll being rotatably mounted on said frame;

a printing roll rigidly mounted on a printing roll shaft, the printing roll shaft being rotatably mounted in a supporting frame structure, the supporting frame structure being rigidly mounted on the frame with said printing roll contacting said ink roll;

an ink trough supported by said frame, the ink trough containing a quantity of ink, the ink being applied to a cylindrical surface of the ink roll as the ink roll rotates past the ink trough;

a pair of pivotably mounted members supported by said frame, each member having a first arm, the pair of first arms supporting opposite ends of a reverse angle doctor blade assembly, said reverse angle doctor blade assembly supporting a doctor blade, the doctor blade having a wiping edge at one end thereof which engages the cylindrical surface of the ink roll, the doctor blade being mounted so as to form an obtuse angle relative to the cylindrical surface of the ink roll approaching the doctor blade, the doctor blade assembly being advanced by said pivotably mounted members into an operative position in which the wiping edge of the doctor blade engages the cylindrical surface of the ink roll with said wiping edge being in parallel alignment with a longitudinal axis of said ink roll and at a location on the cylindrical surface intermediate a location of the ink trough and a further location where the ink roll engages the printing roll, in a direction of rotation of the ink roll;

a second arm of each pivotably mounted member being engaged by actuator means continuously applying a force to each pivotally mounted member pivoting each pivotably mounted member about a respective pivot point with the wiping edge of the doctor blade being continuously biased into line contact with the cylindrical surface of the ink roll at equal force along the length of said doctor blade;

a shaft portion mounted on each end of the doctor blade assembly, a mounting bracket mounted on each shaft portion by means of a self-aligning bearing situated in each mounting bracket, each mounting bracket engaging cooperating means mounted on the first arm of each pivotably mounted member, the cooperating means releasably retaining the mounting brackets in contact with the first arms of the pivotably mounted members, at least one end of said doctor blade assembly includes adjusting means, said adjusting means comprising a member rigidly secured to the shaft portion of the assembly, said member supporting an adjustment screw having a ball-like end in engagement with a cooperating slot located in a follower member, the follower member being slidably movable along a curved path situated on a holder, the holder being secured to a side of the doctor blade assembly mounting bracket and the curved path being of constant radius with respect to a center of its respective shaft portion, a position of the follower member on the curved path being manually adjustable by clamp means in order to releasably retain said follower member at a desired location on said curved path, said manual adjustment of said follower member permitting the member secured to the shaft portion and its engaging means to be set in a desired angular position relative to said respective mounting bracket, whereby an angle of said doctor blade with respect to a tangent to the cylindrical surface of said ink roll is obtainable, the ball-like end of the adjusting screw permitting the mounting bracket to pivot on the shaft portion about said ball-like end in any position of engagement of the ball-like end with the cooperating slot in the follower member, whereby tilting of said mounting bracket relative said shaft portion and member rigidly mounted thereon is obtained and self-aligning movement of said doctor blade assembly relative to said ink roll is achieved.

2. An improved flexographic printer according to claim 1, wherein said cooperating means comprises an axle mounted on each first arm, each axle having a plate secured thereto and each plate having a pin mounted thereon, each axle and respective pin cooperating to releasably engage a respective mounting bracket.

3. An improved flexographic printer according to claim 1, wherein said ink trough is removably supported by said frame, said ink trough having a blade, a leading edge of which is in contact with the cylindrical surface of the ink roll, said blade in cooperation with a portion of the cylindrical surface of the ink roll forming a film of ink on the cylinder surface of the ink roll during rotation thereof past the ink trough.

4. An improved flexographic printer according to claim 3, wherein said ink trough is provided with an ink inlet in a bottom of the trough, a baffle plate being situated in the trough above the inlet, the baffle plate limiting spraying of ink entering said ink trough through said inlet, said trough having an overflow means adjacent an upper edge thereof, said overflow means limiting ink accumulation within said ink trough.

5. An improved flexographic printer according to claim 3, wherein said ink trough cooperates with the cylindrical surface to define a funnel-like portion which narrows in the direction of rotation of the ink roll, said blade being situated at the lowermost location of the funnel-like portion.

6. An improved flexographic printer according to claim 1, wherein the pivotably mounted members are of identical bellcrank construction and the cooperating means comprises an axle extending in a direction away from the adjacent first arm, each axle having a plate rigidly secured thereto, each plate including a rigid pin mounted thereon, each mounting bracket having a hook portion at the outer end thereof, the hook portion releasably engaging beneath a respective one of the axles, and a lower surface of the hook portion resting on a respective rigid pin.

7. An improved flexographic printer according to claim 1, wherein said doctor blade is of steel construction.

8. An improved flexographic printer according to claim 1, wherein said actuator means comprise a pair of fluid actuated diaphragms, each pivotably mounted member having a rod of a respective fluid cylinder engaging a second arm thereof, each fluid diaphragm adapted to apply an identical force to the second arm of each pivotably mounted member in order that equivalent forces are transmitted to the first arms and to opposite ends of the doctor blade assembly supported thereby.

9. An improved flexographic printer according to claim 1, wherein said frame includes a stationary base supporting a movable first sub-frame assembly, said sub-frame assembly including a first pair of longitudinally movable members slidable with respect to the base, each longitudinally movable member supporting a respective end of said ink roll shaft and said ink trough, and one of said pivotably mounted members; a first transverse shaft supported by the base and having a pair of gears thereon, each gear on said first transverse shaft meshing with a further gear mounted on longitudinally extending shaft, each first longitudinally extending shaft having a threaded portion engaging a non-rotatable threaded member mounted in one of the first longitudinally movable members, said first transverse shaft including first manual adjustment means whereby at least one of the gears on one of the longitudinally extending shafts is rotatable and at least one of the first longitudinally movable members is advanced longitudinally by said first adjustment means relative to the other first longitudinally movable member. .

10. An improved flexographic printer according to claim 9, wherein said frame includes a second movable sub-frame assembly, said second sub-frame assembly including a second pair of longitudinally movable members slidable with respect to said stationary base, said second pair of longitudinally movable members supporting said first sub-frame and being adapted further to support opposite ends of a printing roll, a second transverse shaft supported by the base and having a pair of gears mounted thereon, each gear on said second transverse shaft meshing with a further gear mounted on a second longitudinally extending shaft, each second longitudinally shaft having a threaded portion engaging a non-rotatable threaded member in one of the second pair of longitudinally movable members, said second transverse shaft including second manual adjustment means whereby at least one of the gears on one of the second pair of longitudinally extending shafts is rotatable and at least one of the second longitudinally movable members is advanced longitudinally by said second adjustment means relative to the other second longitudinally movable member.

11. An improved flexographic printer according to claim 10, wherein a double-acting fluid cylinder is operatively connected to each of said first pair of longitudinal members, said cylinders locking said ink roll in contact with rubber plates mounted on a cylindrical surface of the printing roll, a gear mounted on the ink roll shaft and a gear mounted on the printing roll shaft, the gears being in engagement when the ink roll is in contact with the cylindrical surface of the printing roll, said cylinders being connected to a fluidic system, the cylinders being actuated by the fluidic system when operation of the flexographic printer ceases in order to separate said rolls without disengaging the ink roll gear and the printing roll gear, a source of power is operatively connected to the ink roll shaft, said source of power rotating said ink roll when the ink roll is disengaged from the printing roll.

* * * * *